US012065180B2

(12) United States Patent
Bohme

(10) Patent No.: US 12,065,180 B2
(45) Date of Patent: Aug. 20, 2024

(54) ADAPTOR ASSEMBLY FOR A GATE MECHANISM

(71) Applicant: Siemens Mobility, Inc., New York, NY (US)

(72) Inventor: Richard C. Bohme, Louisville, KY (US)

(73) Assignee: Siemens Mobility, Inc., New York, NY (US)

( * ) Notice: Subject to any disclaimer, the term of this patent is extended or adjusted under 35 U.S.C. 154(b) by 750 days.

(21) Appl. No.: 17/320,507

(22) Filed: May 14, 2021

(65) Prior Publication Data

US 2022/0363299 A1 Nov. 17, 2022

(51) Int. Cl.
*B61L 29/04* (2006.01)

(52) U.S. Cl.
CPC ..... *B61L 29/04* (2013.01)

(58) Field of Classification Search
CPC ..... B61L 29/04; B61L 29/08; B61L 29/10; B61L 29/12; B61L 29/14; B61L 29/16
See application file for complete search history.

(56) References Cited

U.S. PATENT DOCUMENTS 2,710,342 A * 6/1955 Dilley ..... B61L 29/243 246/130
3,038,991 A * 6/1962 Swanton ..... B61L 29/226 246/219
4,057,208 A * 11/1977 Andrews ..... B61L 29/04 49/138
5,653,058 A * 8/1997 Zaimins ..... B61L 29/04 49/34
2008/0093509 A1* 4/2008 Woodlief ..... B61L 29/00 246/473.1
2019/0351926 A1* 11/2019 Ibarra ..... B61L 29/288

FOREIGN PATENT DOCUMENTS

WO WO-2006092283 A1 * 9/2006 ..... B61L 29/04
WO WO-2011139139 A1 * 11/2011 ..... B61L 29/04

OTHER PUBLICATIONS

S-60 Highway Grade Crossing Gate, Installation and Maintenance, Jun. 2017, Document No. 074050, Version F, Siemens Rail Automation Corporation, 158 pages.

* cited by examiner

*Primary Examiner* — Robert J McCarry, Jr.

(57) ABSTRACT

There is described an adaptor assembly of a gate mechanism for aligning a gear motor with a shaft driving gear. The assembly comprises a gate mechanism housing, a shaft driving motor, an adaptor, and fasteners. The housing includes a bore having an inner dimension and a housing fastener connection. The shaft driving motor has a motor shaft and a motor fastener connection. The adaptor comprises a housing fastener passage, a motor fastener passage, and a central protrusion. The central protrusion has an outer dimension aligned with the inner dimension of the bore and a central shaft passage accommodating the motor shaft of the shaft driving motor. A first fastener secures the adaptor to the shaft driving motor via the motor fastener passage and the motor fastener connection. A second fastener secures the adaptor to the housing via the housing fastener passage and the housing fastener connection.

14 Claims, 6 Drawing Sheets

ADAPTOR ASSEMBLY FOR A GATE MECHANISM

FIELD OF THE INVENTION

This application relates to the field of gate control systems at railroad/highway crossings and, more particularly, to a gate mechanism of a gate control system that is capable of accommodating one or more components of varying size.

BACKGROUND

A gate control system of a railway crossing serves as a barrier across a highway when trains approach or occupy the crossing. Crossing arms of the gate control system are typically lowered when trains approach and traverse a crossing of a road and a railroad track, and the crossing arms may be raised when the crossing is clear. The gate control system includes an electrical motor and other related components to raise and lower the crossing arms as needed to provide for roadway and pedestrian safety. These components of the gate control system may vary in configuration and/or size. For example, the attachment patterns of a particular component may differ from the corresponding attachment patterns of a housing of the gate control system. Conventional equipment for adapting a component to the system housing are generally expensive, heavy, and/or prone to electrical grounding problems.

SUMMARY

In accordance with one embodiment of the disclosure, there is provided a cost efficient, lighter, and electrically non-conductive approach to adapt a component to a gate mechanism housing for gate control system. In particular, an adaptor composed of a non-metallic material may be molded to minimize material volume, cost, weight, and electrical conductivity. For example, the adaptor may be used to provide electrical isolation of a DC electric motor from the housing of the gate mechanism, thus reducing the chance of grounding problems due to the carbon brushes in the motor.

One aspect is an adaptor assembly of a gate mechanism for aligning a gear motor with a shaft driving gear of the gate mechanism. The assembly comprises a gate mechanism housing, a shaft driving motor, an adaptor, a first fastener, and a second fastener. The gate mechanism housing includes a bore having an inner dimension and a housing fastener connection. The shaft driving motor has a motor shaft and a motor fastener connection. The adaptor comprises a housing fastener passage, a motor fastener passage, and a central protrusion. The central protrusion has an outer dimension aligned with the inner dimension of the bore, and the central protrusion also has a central shaft passage accommodating the motor shaft of the shaft driving motor. The first fastener secures the adaptor to the shaft driving motor via the motor fastener passage and the motor fastener connection. The second fastener secures the adaptor to the gate mechanism housing via the housing fastener passage and the fastener connection.

The above described features and advantages, as well as others, will become more readily apparent to those of ordinary skill in the art by reference to the following detailed description and accompanying drawings. While it would be desirable to provide one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects.

DETAILED DESCRIPTION

Figure 1:
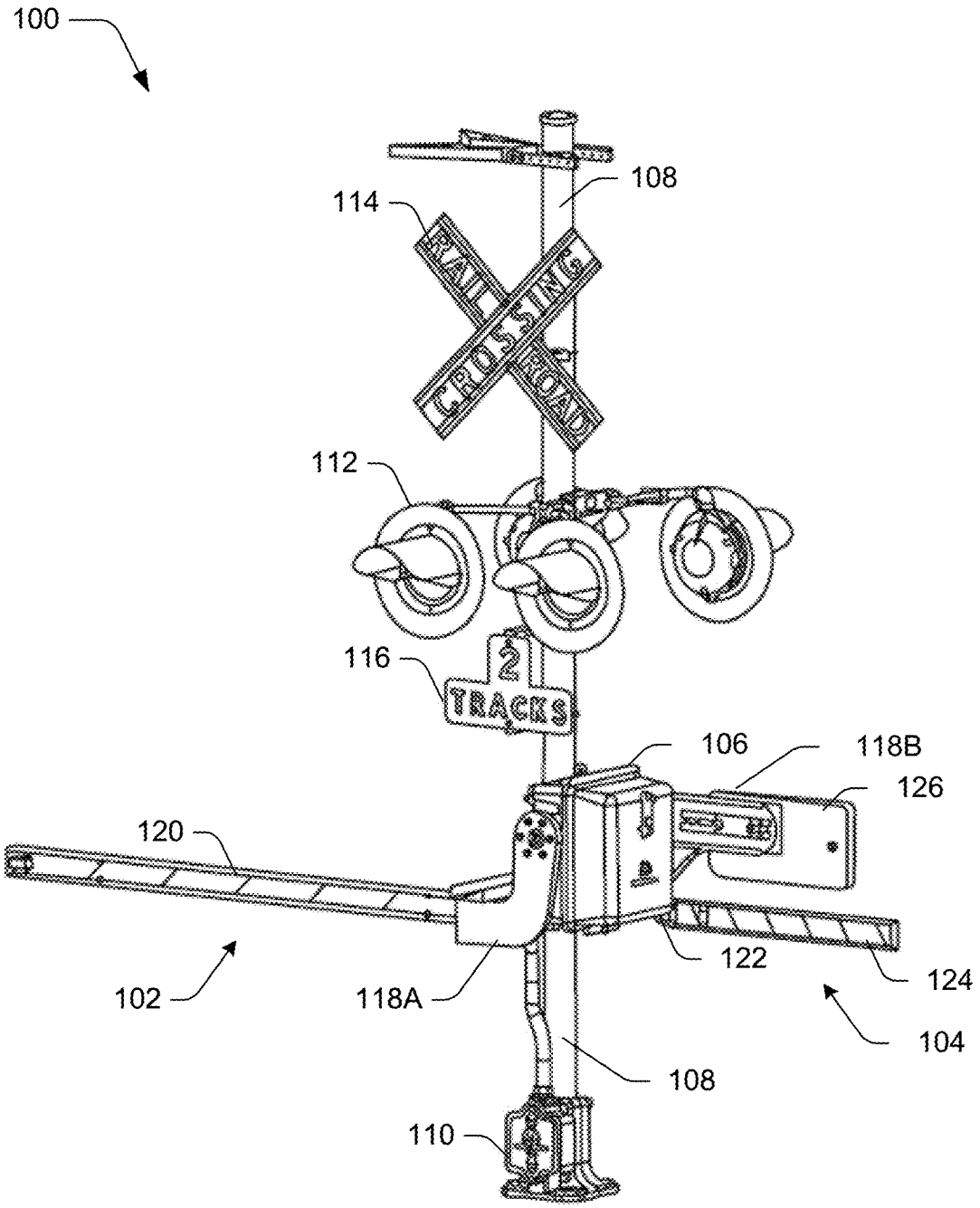
FIG. 1 illustrates of an environment, having a railroad crossing gate, in an example implementation that is operable to employ techniques described herein.

Various technologies that pertain to adaptor assemblies for adapting a component to a gate mechanism housing for gate control system will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

The adaptor assembly minimizes the amount of material needed to perform the function of adapting a component to a gate mechanism housing for gate control system. The adaptor assembly also has the key mounting features needed for compatibility with various types of adaptors. For example, the mounting features of the adaptor assembly may enable backward compatibility with older or existing gate housings, such as a gear motor. Further, at least part of the adaptor of the adaptor assembly is composed of a non-conductive material and, for some embodiments, the adaptor may be composed entirely of one or more non-conductive materials. For conventional equipment, the shaft driving motor may have carbon brushes and, over time, the carbon material may builds-up in the gear motor and be a source of electrical grounds. The adaptor assembly includes an adaptor composed of one or more non-conductive materials to significantly reduce the possibility of motor ground faults, during field usage or for other purposes. The non-conductive material(s) of the adaptor assembly reduces any potential arching problems, which may result in significant expenses, by minimizing paths to earth ground that might cause shorts or other issues for the gate control system.

FIG. 1 illustrates of an environment in an example implementation that is operable to employ techniques described herein. In particular, a railroad crossing gate 100 shown in a lowered or substantially horizontal position. At many railroad crossings, at least one railroad crossing gate 100 may be placed on either side of the railroad track to restrict roadway traffic in both directions. At some crossings, pedestrian paths or sidewalks may run parallel to the roadway. To restrict road and sidewalk traffic, the illustrated railroad crossing gate 100 includes a separate roadway gate 102 and pedestrian gate 104. The roadway gate 102 and pedestrian gate 104 may be raised and lowered by a gate crossing mechanism 106. The gate crossing mechanism 106 provides efficiency and versatility to the operation of the railroad crossing gate 100, including entrance and/or exit gate configuration options. The gate crossing mechanism 106 may be an integral part of a Wayside Information System (WIS) and Wayside Alarm Management System (WAMS) and report data back to an event recorder located along a wayside associated with such systems.

The example railroad crossing gate 100 also includes a pole or mast 108 supported at its base by a foundation or ground surface as well as a pinnacle or bell at the top of the mast 108. The mast 108 supports a junction box 110 to provide electrical and electronic connections for the gate crossing mechanism 106 and other electrical/electronic components of the crossing gate 100, such as flashing signal lights 112. The mast 108 may further support one or more mechanical components such as a railroad crossing sign 114 and/or a track sign 116. The gate crossing mechanism 106 is attached to the mast 108 and is used to raise and lower the roadway and/or pedestrian gates 102, 104. The illustrated railroad crossing gate 100 is often referred to as a combined crossing gate. When a rail vehicle approaches the crossing, the railroad crossing gate 100 may provide a visual warning using the signal lights 112, railroad crossing sign 114, and/or track sign 116. The gate crossing mechanism 106 will lower the roadway gate 102 and the pedestrian gate 104 to respectively restrict traffic and pedestrians from crossing the track until the rail vehicle has passed.

As shown in FIG. 1, the crossing gate 102 comprises first and second counterweight support arms 118A, 118B in which the first counterweight support arm 118A attaches a crossing gate arm 120 to the gate crossing mechanism 106. The pedestrian gate 104 comprises a pedestrian gate support 122 connecting a pedestrian gate arm 124 to the gate crossing mechanism 106. Each counterweight support arm may be a short counterweight support arm or a long counterweight support arm, in which one or more counterweights 126 may be attached the long counterweight support arm(s). For example, the counterweights 126 may be positioned at a long counterweight support arm opposite a support arm corresponding to the crossing gate arm 120 to counterbalance the weight structure of the crossing gate arm. When raised, the roadway and pedestrian gates 102, 104 are positioned so that they do not interfere with either roadway or pedestrian traffic. This position is often referred to as the vertical position, which is not necessarily exactly vertical relative to the ground. A "power-on" braking mechanism or other powered holding device (internal to the gate crossing mechanism 106) is used to hold the gates 102, 104 when they are in the substantially vertical position. The roadway and pedestrian gates 102, 104 are raised and lowered between the substantially horizontal and vertical positions by the gate crossing mechanism 106, 200.

Figure 2:
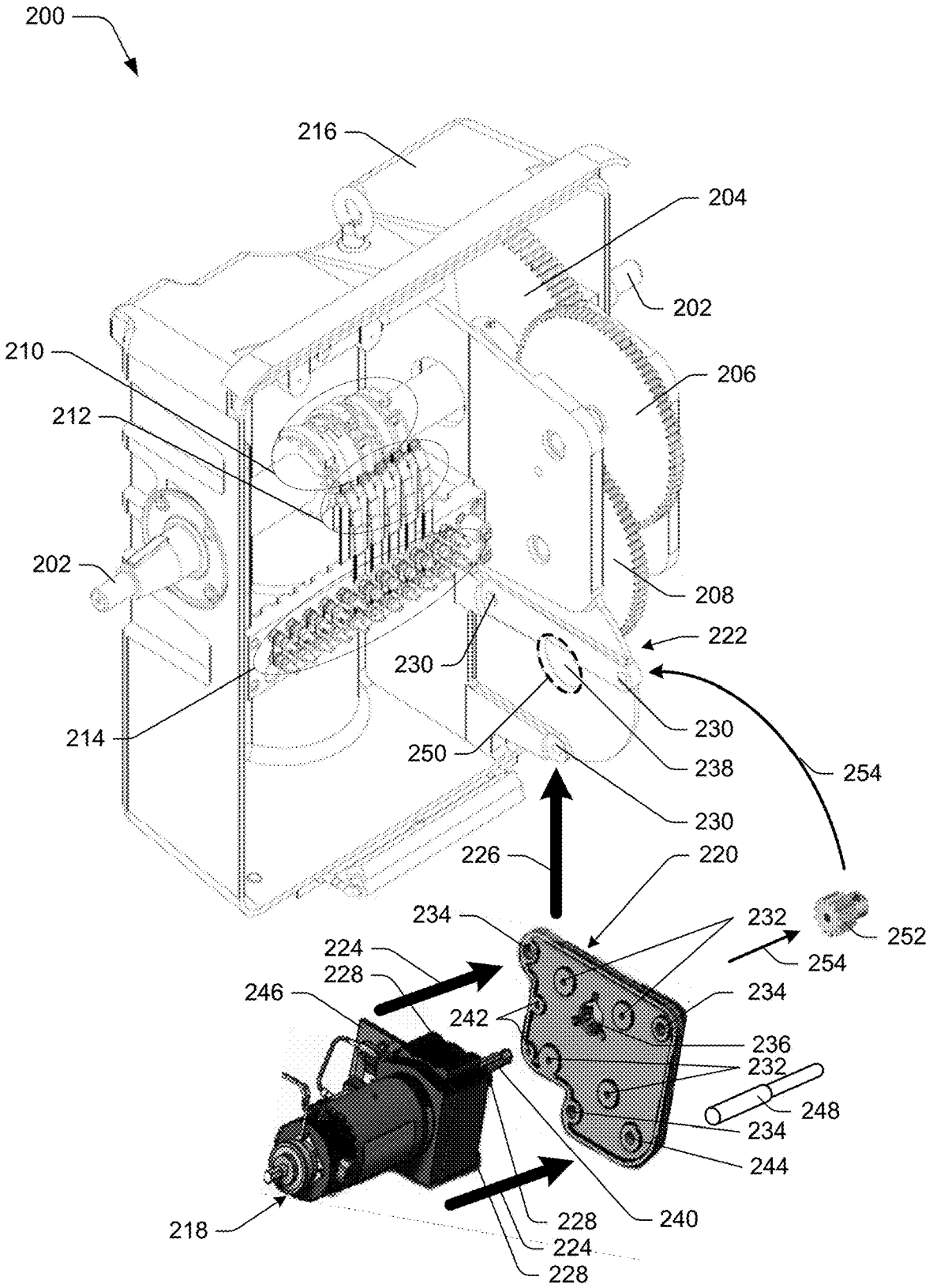
FIG. 2 is a partial perspective view of the gate mechanism of FIG. 1 in an example implementation that is operable to employ the techniques described herein.

Referring to FIG. 2, a gate mechanism 200 (such as the gate crossing mechanism 106 of FIG. 1) includes a shaft 202 connected to the counterweight support arms 118A, 118B and, for some embodiments, connected to the pedestrian gate support 122 as well. The gate mechanism 200 further includes various electrical and mechanical components to drive and control the shaft 202, such as a segment gear 204 coupled to the shaft, upper and lower gears and pinions 206, 208 operating in conjunction with the segment gear 204, shaft cams 210 coupled to the shaft away from the segment gear, shaft contacts 212 responsive to position and/or movement of the shaft and the shaft cams, and a terminal board assembly 214 for connections with other devices. The interaction of these components are important to the operation of the railroad crossing gate 100. For example, the shaft cams 210 are positioned on the shaft 202 such that they open and close shaft contacts 212 at various angles of the shaft and corresponding gate arm(s) 120, 124. Other components of the gate mechanism 200 include a motor assembly to drive the gearing 204, 206, 208, stop bar, defroster, upper and lower buffer assembly, and electrical/electronic control circuits, and various electrical wiring, some of which are not shown in FIG. 2 to facilitate an understanding of the general operation of the shaft 202. A gate mechanism housing 216 of the gate mechanism 200 supports the components of the gate mechanism and provides protection for at least some components from elements external to the gate mechanism.

The gate mechanism also includes a gear motor (such as a shaft driving motor 218), an adaptor 220, and a supporting structure 222 of the gate mechanism housing 216. The shaft driving motor 218 may attach to the adaptor 220 in a first direction 224, and the combined shaft driving motor and adaptor 218, 220 may attach to the supporting structure 222 in a second direction 226. The first and second directions 224, 226 may be similar or different without departing from the intended function of the adaptor assembly and its components. The shaft driving motor 218 may be powered by any type of energy source. For example, the shaft driving motor 218 may be an electrical motor that includes a wired connection to a DC power source.

For installing the shaft driving motor 218 to the gate mechanism housing 216, the adaptor 220 is configured to align with a motor attachment pattern of one or more motor fastener connections 228 of the shaft driving motor and a housing attachment pattern of one or more housing fastener connections 230 of the gate mechanism housing. In particular, the adaptor 220 includes one or more motor fastener passages 232 aligning with the motor fastener connections 228 and one or more housing fastener passages 234 aligning with the housing fastener connections 230. The adaptor 220 also includes a central shaft passage 236 configured to function in conjunction with a bore 238 of the gate mechanism housing 216. The central shaft passage 236 and the bore 238 are configured to maintain a motor shaft 240 of the shaft driving motor 218 aligned centrally to allow for proper gear tooth alignment of a motor pinion gear of the shaft driving motor with a shaft driving gear, such as lower gear 208.

The adaptor 220 further includes additional passages or connections 242, 244 to accommodate other components associated with the shaft driving motor 218, such as a defroster 246 or a reaction pin 248. For some embodiments, the adaptor 220 may include at least two passages 242 for mounting the defroster 246 to the adaptor assembly. The defroster 246 may facilitate maintenance of an ambient temperature of the shaft driving motor 218 to keep frost off the contacts 212. For some embodiments, the adaptor 220 may include at least one passage or connection 244 for accommodating a tapped-in reaction pin 248. The gate mechanism 200 may utilize a lock bar tool that fits over the motor shaft 240 and the reaction pin 248 to prevent the gear train from turning. The reaction pin restricts movement of the lock bar as needed.

The bore 238 of the gate mechanism housing 216 includes an inner dimension 250 for receiving and aligning a corresponding protrusion of the adaptor 220. Also, the shaft driving motor 218 may include a motor pinion gear 252 positioned at one end of the motor shaft 240 for proper gear tooth alignment with a shaft driving gear (such as lower gear 208), as represented by arrows 254 of FIG. 2.

Figure 3:
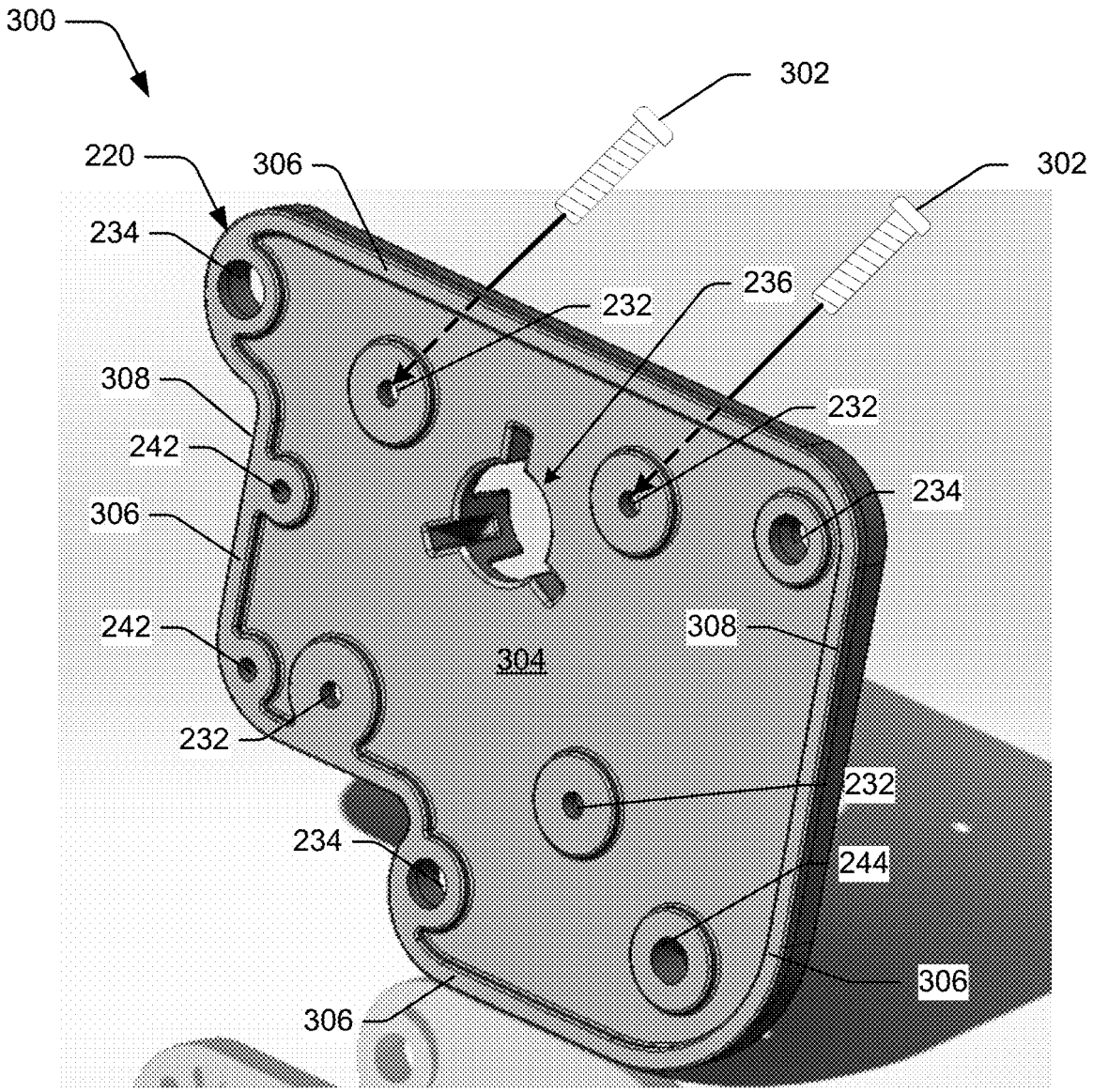
FIG. 3 is a perspective view of a back side of the adaptor of FIG. 2.

Referring to FIG. 3, in conjunction with FIG. 2, there is shown a perspective view of a back side 300 of the adaptor 220. All key mounting points of the adapter 220 have a predetermined minimum thickness and locations to align with the motor attachment pattern of the shaft driving motor 218 and the housing attachment pattern of the gate mechanism housing 216. In particular, one or more motor fastener passages 232 align with corresponding motor fastener connections 228 of the shaft driving motor 218, and one or more housing fastener passages 234 align with corresponding housing fastener connections 230 of the gate mechanism housing 216. To support the shaft driving motor 218 to the adaptor 220, one or more first fasteners 302 may be passed through the motor fastener passages 232 and secured to corresponding motor fastener connections 228. Accordingly, the first fastener or fasteners 302 secure the adaptor 220 to the shaft driving motor 218 via the motor fastener passage 232 and the motor fastener connections 228. The adaptor 220 also includes a central shaft passage 236 configured to function in conjunction with the bore 238 of the gate mechanism housing 216 to maintain the motor shaft 240 of the shaft driving motor 218 aligned centrally within the central shaft passage and the bore. In this manner, the motor shaft 240 aligns the motor pinion gear 252 with the shaft driving gear, such as the lower gear 208, to allow for proper gear tooth alignment.

The adapter 220 may be composed, in part, of a non-conductive material. For some embodiments, the adapter may be composed entirely of one or more non-conductive materials. For other embodiments, part but not all of the adapter 220 is composed of one or more non-conductive materials. Based on the material selection, the adapter assembly, including the adapter 220, may electrically isolate the shaft driving motor 218 from the gate mechanism housing 216 to reduce or minimize the possibly of grounds existing when testing or operating the railroad crossing gate 100.

Utilizing the non-conductive material, portions of the adapter 220 may be relieved or otherwise configured in non-critical areas to save weight and/or material. The relieved/configured areas may be designed or created by following good design practices in keeping consistent cross section thickness or thicknesses for facilitated moldability. In particular, the back side 300 of the adapter 220 includes a substantially planar back surface 304. The back side 300 may also include a back outer rib 306 that is continuous along a back perimeter 308 of the back side that is raised from the substantially planar back surface 304. For some embodiments, the housing fastener passage 234 and the motor fastener passage 232 are raised from the substantially planar back surface 304 to provide a solid foundation for securing the adapter 220 to the shaft driving motor 218. In addition, at least one of the motor fastener passages 232 and/or the housing fastener passages 234 may partially coincide or be integrated with the back outer rib 306.

Figure 4:
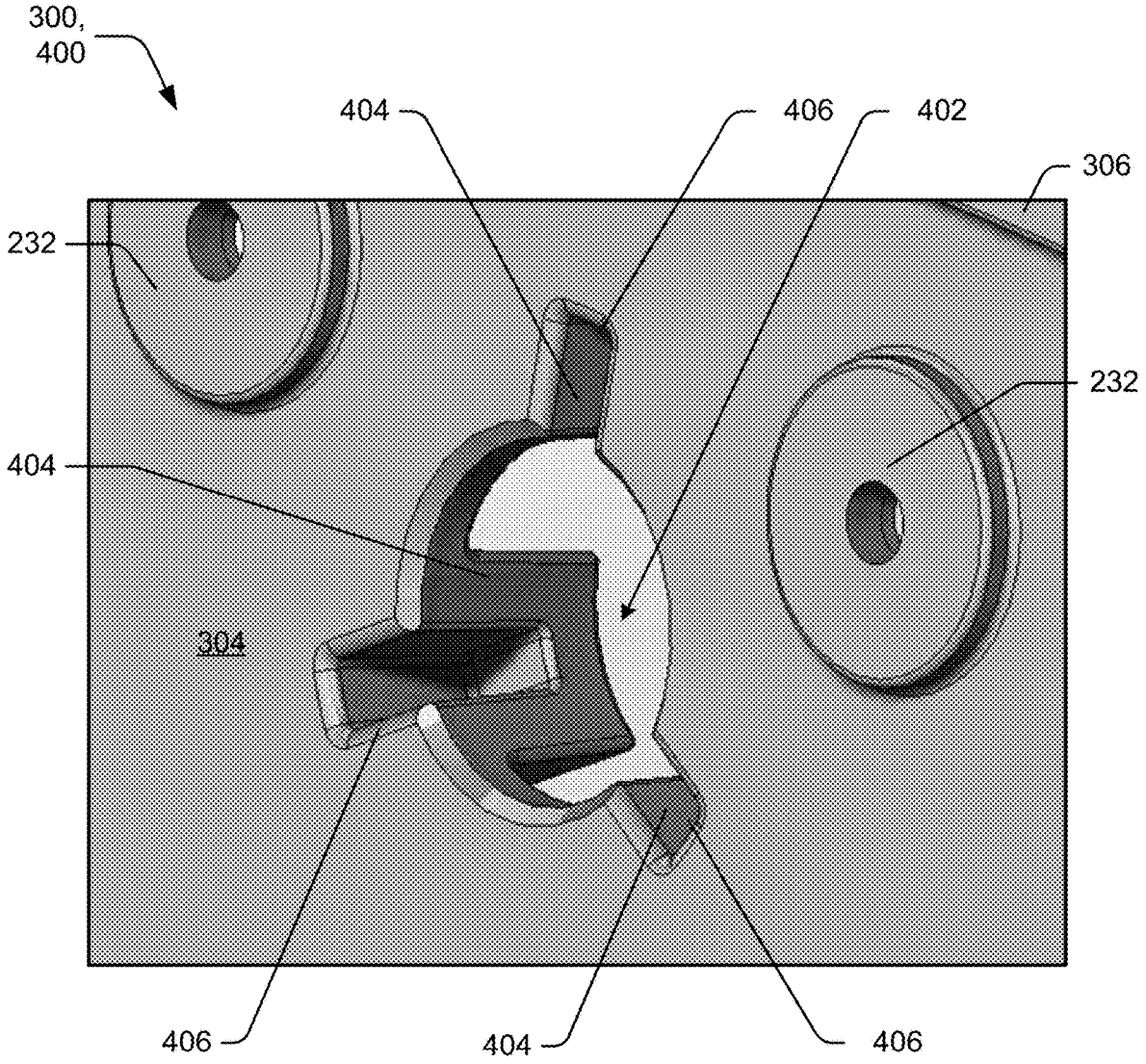
FIG. 4 is a magnified, partial perspective view of the back side of the adaptor of FIG. 3.

Referring to FIG. 4, there is shown a magnified, partial perspective view 400 of the back side 300 of the adaptor 220 in which the back may be positioned adjacent to the shaft driving motor 218. A central protrusion 402 at the back side 300 of the adaptor 220 may recede from the substantially planar back surface 304 of the adaptor. For some embodiments, the central protrusion 402 may include multiple lobes or central protrusion segments 404 that recede to a front side of the adaptor 220. For example, each lobe of the central protrusion segments 404 many have an inner cavity 406 as a result of the extrusion or molding process of the non-conductive material. For some embodiments, the central protrusion segments 404 may include three or more central protrusion segments. This design feature reduces the amount of material need to create the central protrusion 402 while maintaining consistent cross sectional thickness and concentricity between the back and front sides of the adaptor 220.

Figure 5:
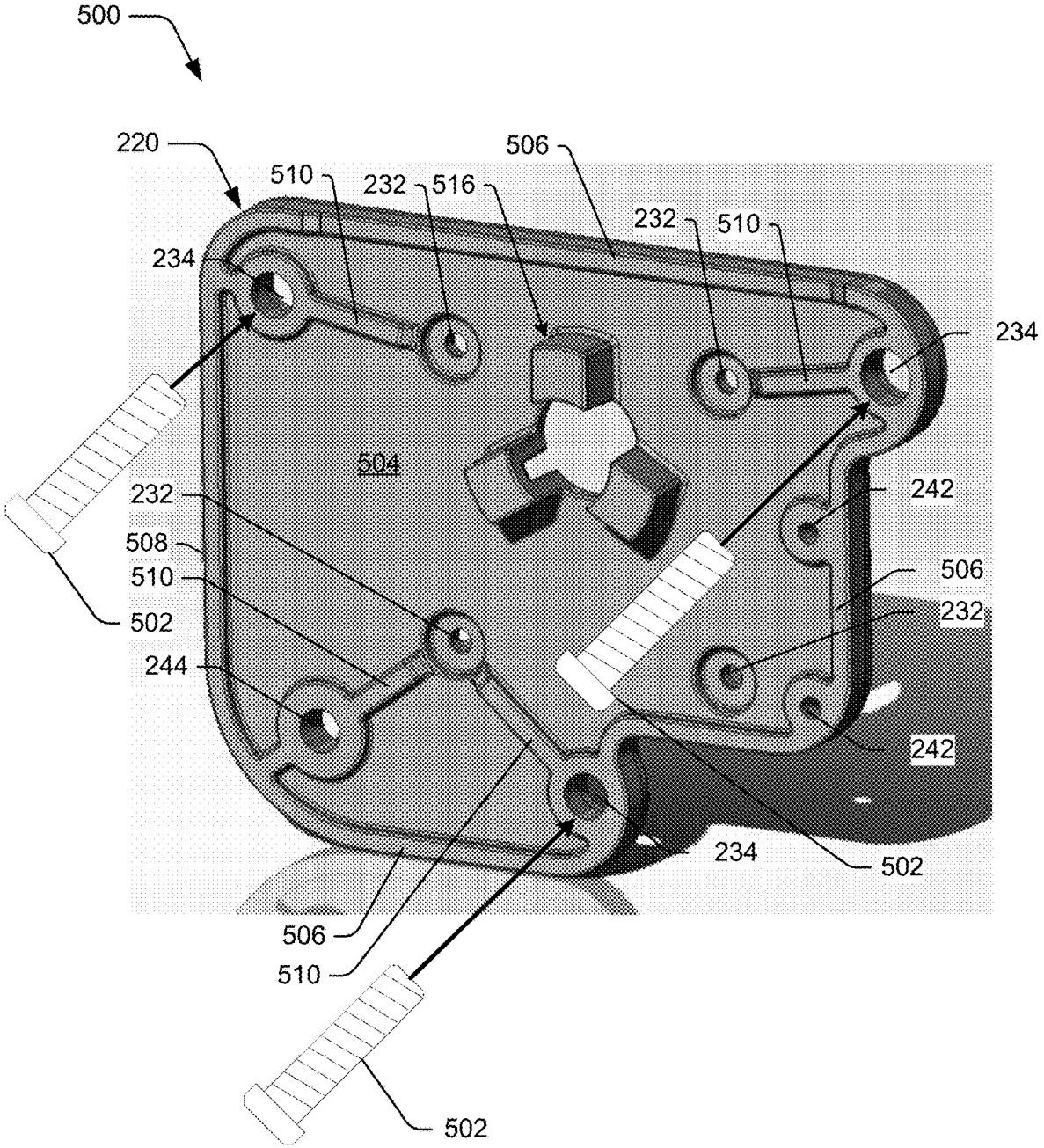
FIG. 5 is a perspective view of a front side of the adaptor of FIG. 2.

Referring to FIG. 5, in conjunction with FIG. 2, there is shown a perspective view of a front side 500 of the adaptor 220. All key mounting points of the adapter 220 have a predetermined minimum thickness and locations to align with the motor attachment pattern of the shaft driving motor 218 and the housing attachment pattern of the gate mechanism housing 216. One or more motor fastener passages 232 align with corresponding motor fastener connections 228 of the shaft driving motor 218, and one or more housing fastener passages 234 align with corresponding housing fastener connections 230 of the gate mechanism housing 216. To support the gate mechanism housing 216 to the adaptor 220, one or more second fasteners 502 may be passed through the housing fastener passages 234 and secured to corresponding housing fastener connections 230. Accordingly, the second fastener or fasteners 502 secure the adaptor 220 to the gate mechanism housing 216 via the housing fastener passage 234 and the housing fastener connection 230. The adaptor 220 also includes a central shaft passage 236 configured to function in conjunction with the bore 238 of the gate mechanism housing 216 to maintain the motor shaft 240 of the shaft driving motor 218 aligned centrally within the central shaft passage and the bore. In this manner, the motor shaft 240 aligns with the shaft driving gear, such as the lower gear 208, to allow for proper gear tooth alignment.

Similar to the back side 300, portions of the adapter 220 may be relieved or otherwise configured in non-critical areas to save weight and/or material. The front side 500 of the adapter 220 includes a substantially planar front surface 504. The front side 300 may also include a front outer rib 506 that is continuous along a front perimeter 508 of the front side that is raised from the substantially planar front surface 504. For some embodiments, the housing fastener passage 234 is raised from the substantially planar front surface 504 to provide a solid foundation for securing the adapter 220 to the gate mechanism housing 216. For some embodiments, the motor fastener passage 232 recedes from the substantially planar front surface 504 to provide a recessed area within the substantially planar front surface 504 to avoid any unwanted collision or counter-impact of a head end of the first fastener (s) and the housing the shaft driving motor 218. In this manner, the recessed areas are "counterboard" so that the head ends of the first fasteners do not extend beyond the surface of the adaptor 220, thus avoid interference with the surface of the motor housing. In addition, at least one of the motor fastener passages 232 and/or the housing fastener passages 234 may partially coincide or be integrated with the front outer rib 506. The front side 500 of the adaptor 220 may further include inner ribs 510 adjacent to the motor fastener passages 232, the housing fastener passages 234, and/or additional passages or connections 242, 244 to further strengthen the adaptor 220 at those key areas.

Figure 6:
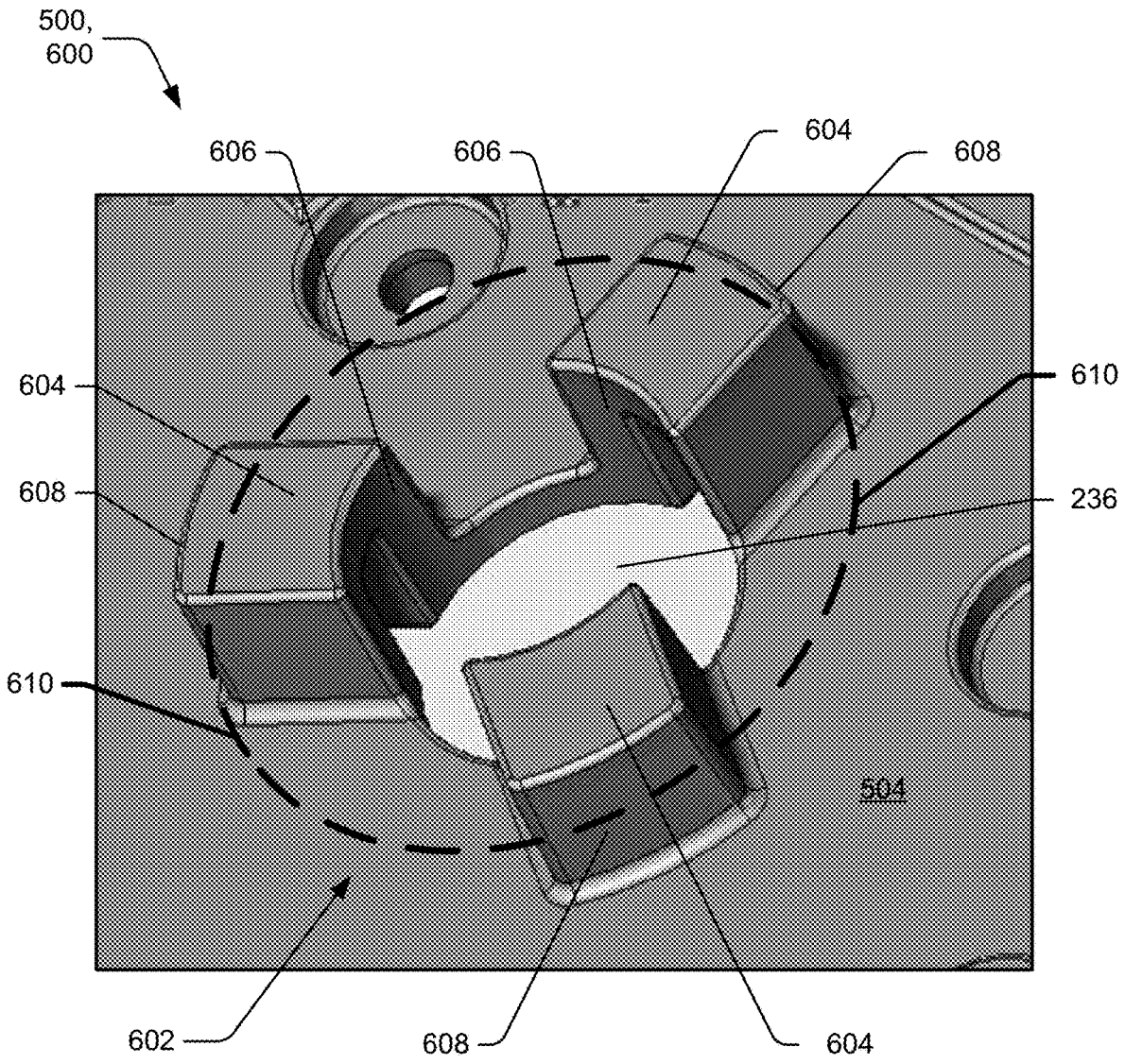
FIG. 6 is a magnified, partial perspective view of the front side of the adaptor of FIG. 5.

Referring to FIG. 6, there is shown a magnified, partial perspective view 600 of the front side 500 of the adaptor 220 in which the front may be positioned adjacent to the gate mechanism housing 216. The central protrusion 602 at the front side 500 of the adaptor 220 may protrude or otherwise extend from the substantially planar front surface 504 of the adaptor. For some embodiments, the central protrusion 602 may include multiple lobes or central protrusion segments 604 that protrude or extend from the front side 500 of the adaptor 220. For example, each lobe of the central protrusion segments 604 many have an inner surface 606 to form or accommodate a central shaft passage 236, having a diameter greater than a diameter of the motor shaft, to maintain the motor shaft 240 of the shaft driving motor 218 aligned centrally within the central shaft passage and the bore 238. In this manner, the motor shaft 240 aligns with the shaft driving gear, such as the lower gear 208, to allow for proper gear tooth alignment. For some embodiments, the central protrusion segments 604 may include three or more central protrusion segments.

The front side 500 of the adaptor 220 has a centering pilot to facilitate proper engagement with the gate mechanism housing 216. The centering pilot of the adaptor 220 may include a solid mounting hub or multiple points of contact. The multiple points of contact may be designed to ease installation (i.e., less surface area and less friction) while maintaining the motor position accuracy of the solid mounting hub. In fact, the multiple lobes or segments 604 may allow for a thinner cross section of the adaptor 220 than a solid mounting hub as well as a lighter overall weight. For some embodiments, the central protrusion 602 includes multiple central protrusion segments 604 in which each lobe or segment has an outer arcuate surface 608 aligning with a portion of the inner dimension 250 of the bore 238 of the gate mechanism housing 216. The central protrusion 602 has an outer dimension 610 aligned with the inner dimension 250 of the bore 238 as well as the central shaft passage 236 which accommodating the motor shaft 240 of the shaft driving motor 218. For some embodiments, the central protrusion may be raised from the substantially planar front surface beyond the height of the front outer rib and the housing fastener passage to provide a secure fit to the bore 238 of the gate mechanism housing 216.

Those skilled in the art will recognize that, for simplicity and clarity, the full structure and operation of all data processing systems suitable for use with the present disclosure are not being depicted or described herein. Also, none of the various features or processes described herein should be considered essential to any or all embodiments, except as described herein. Various features may be omitted or duplicated in various embodiments. Various processes described may be omitted, repeated, performed sequentially, concurrently, or in a different order. Various features and processes described herein can be combined in still other embodiments as may be described in the claims.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an example embodiment of the present disclosure has been described in detail, those skilled in the art will understand that various changes, substitutions, variations, and improvements disclosed herein may be made without departing from the spirit and scope of the disclosure in its broadest form.

What is claimed is:

1. An adaptor assembly of a gate mechanism for aligning a gear motor with a shaft driving gear of the gate mechanism, the assembly comprising:

a gate mechanism housing including a bore having an inner dimension and a housing fastener connection;

a shaft driving motor having a motor shaft and a motor fastener connection;

an adaptor comprising a housing fastener passage, a motor fastener passage, and a central protrusion having an outer dimension aligned with the inner dimension of the bore and a central shaft passage accommodating the motor shaft of the shaft driving motor, wherein a first fastener secures the adaptor to the shaft driving motor via the motor fastener passage and the motor fastener connection, and a second fastener secures the adaptor to the gate mechanism housing via the housing fastener passage and the fastener connection.

2. The adaptor assembly as described in claim 1, wherein the adaptor includes a back side having a substantially planar back surface and a back outer rib continuous along a back perimeter of the back side that is raised from the substantially planar back surface.

3. The adaptor assembly as described in claim 2, wherein the housing fastener passage and the motor fastener passage are raised from the substantially planar back surface.

4. The adaptor assembly as described in claim 3, wherein the central protrusion recedes from the substantially planar back surface.

5. The adaptor assembly as described in claim 1, wherein the adaptor includes a front side having a substantially planar front surface and a front outer rib continuous along a front perimeter of the front side that is raised from the substantially planar front surface.

6. The adaptor assembly as described in claim 5, wherein the housing fastener passage is raised from the substantially planar front surface, and the motor fastener passage recedes from the substantially planar front surface.

7. The adaptor assembly as described in claim 6, wherein the central protrusion is raised from the substantially planar front surface beyond the height of the front outer rib and the housing faster passage.

8. The adaptor assembly as described in claim 1, wherein the central shaft passage has a diameter greater than a diameter of the motor shaft.

9. The adaptor assembly as described in claim 1, wherein the central protrusion includes a plurality of central protrusion segments, each central protrusion segment having an outer arcuate surface aligning with a portion of the inner dimension of the bore.

10. The adaptor assembly as described in claim 1, wherein the plurality of central protrusion segments include at least three central protrusion segments.

11. The adaptor assembly as described in claim 1, wherein at least part of the adaptor is composed of a non-conductive material.

12. The adaptor assembly as described in claim 11, wherein the adaptor is composed entirely of one or more non-conductive materials.

13. The adaptor assembly as described in claim 1, wherein the adaptor includes a third passage for accommodating a defroster.

14. The adaptor assembly as described in claim 1, wherein the adaptor includes a third passage for accommodating a reaction pin.

* * * * *